US007987788B2

(12) United States Patent
Zachrisson

(10) Patent No.: US 7,987,788 B2
(45) Date of Patent: Aug. 2, 2011

(54) DISPENSER ARRANGEMENT FOR DISCHARGING COUNTERMEASURE MEANS

(75) Inventor: Björn Zachrisson, Sollentuna (SE)

(73) Assignee: SAAB AB, Linköping (SE)

( * ) Notice: Subject to any disclaimer, the term of this patent is extended or adjusted under 35 U.S.C. 154(b) by 221 days.

(21) Appl. No.: 12/307,000

(22) PCT Filed: Jun. 20, 2007

(86) PCT No.: PCT/EP2007/056149

§ 371 (c)(1),
(2), (4) Date: Dec. 30, 2008

(87) PCT Pub. No.: WO2008/000675

PCT Pub. Date: Jan. 3, 2008

(65) Prior Publication Data

US 2009/0193962 A1 Aug. 6, 2009

(30) Foreign Application Priority Data

Jun. 30, 2006 (EP) ..... 06116384

(51) Int. Cl.
*F42B 4/00* (2006.01)

(52) U.S. Cl. ..... 102/345; 102/342; 102/357; 102/505; 89/1.51

(58) Field of Classification Search ..... 102/345, 102/505, 342, 357, 360; 89/1.59, 1.51, 1.816; 342/12

See application file for complete search history.

(56) References Cited

U.S. PATENT DOCUMENTS

| | | | |
|---|---|---|---|
| 3,808,940 A | 5/1974 | Schillreff et al. | |
| 5,115,711 A | 5/1992 | Bushagour et al. | |
| 5,413,024 A * | 5/1995 | Plummer | 89/1.816 |
| 5,554,815 A | 9/1996 | Authie et al. | |

FOREIGN PATENT DOCUMENTS

| | | |
|---|---|---|
| DE | 2254235 A1 | 5/1974 |
| EP | 0609026 A | 8/1994 |
| EP | 0641989 A1 | 3/1995 |
| FR | 925435 A | 9/1947 |
| FR | 996756 A | 12/1951 |
| GB | 1329514 A | 9/1973 |
| WO | WO-2004/102108 A1 | 11/2004 |

OTHER PUBLICATIONS

International Preliminary Report on Patentability, issued in related International Application No. PCT/EP2007/056149, Jan. 15, 2009.

Written Opinion of the International Searching Authority issued in related PCT/EP2007/05149, Jan. 15, 2009.

PCT/ISA/210—International Search Report—Feb. 15, 2008.

European Search Report—Apr. 11, 2007.

* cited by examiner

*Primary Examiner* — James S Bergin

(74) *Attorney, Agent, or Firm* — Venable LLP; Eric J. Franklin

(57) ABSTRACT

A dispenser for a platform, configured to be mounted to the platform and connected to power- and control-systems of the platform. The dispenser includes a magazine for a plurality of pyrotechnic countermeasure cartridges. The magazine is configured for removable fixation to the dispenser by one single fixing bolt in a central location thereof for securing the magazine to the dispenser in an operative mode. A first lock associated with the dispenser and a second lock associated with the magazine are configured to arrest the fixing bolt in interlocking engagement with the first lock and preventing the fixing bolt from coming loose due to environmental influence.

16 Claims, 9 Drawing Sheets

DISPENSER ARRANGEMENT FOR DISCHARGING COUNTERMEASURE MEANS

CROSS-REFERENCE TO RELATED APPLICATIONS

This application claims priority to European patent application 06116384.6 filed 30 Jun. 2006 and is the national phase under 35 U.S.C. §371 of PCT/EP2007/056149 filed 20 Jun. 2007.

BACKGROUND OF THE INVENTION

1. Technical Field of the Invention

The present invention relates to onboard pyrotechnic devices for a platform, for example an aircraft or a naval vessel etc. for discharging countermeasure means combining in a single device a plurality of pyrotechnic charges (cartridges) which can be fired in succession, for example to launch flares or chaff such as infrared or electromagnetic chaff. More particularly, the invention relates to a dispenser for a platform, configured to be mounted to said platform and connected to its power- and control-systems, comprising a magazine for a plurality of pyrotechnic countermeasure cartridges, said magazine being configured for removable fixation to said dispenser by means of a bolt assembly for securing the magazine to the dispenser in an operative mode.

2. Description of Related Art

Conventionally, a dispenser arrangement of the above mentioned kind involves a magazine or cassettes for a plurality of cartridges, which can be fixed to a body of the arrangement by means of locking elements such as screw fastenings, clamping devices or the like. Hitherto, for a reliable force resistant fixation under operative-service conditions usually four screw bolts have been used for said fixation. This is space consuming, as four screw bolts might consume up to eight cartridge places in the magazine.

U.S. Pat. No. 5,554,815 describes a countermeasure cartridge-launcher loader on aircraft of this type, which comprises a plurality of modules each in the form of a flat strip of juxtaposed cartridges each comprising a payload of chaff, an ejector pyrotechnic charge, an electrical initiator and e reusable support receiving the strips. The support has a system for immobilizing the strips and a handle for transporting and installing it. The strips are juxtaposed at their flat surface to perform a homogeneous block essentially constituting the body of the munition or a part thereof. The support includes a fixed plate carrying the strips and receiving the latter, when they are inserted, by virtue of them sliding in a general direction parallel to the plane of the plate.

SUMMARY OF THE INVENTION

It is an object of the present invention to provide a reliable dispenser arrangement with an improved capacity to weight ratio and which is easier to load and reload than conventional dispensers.

Another object is to optimize the stowage of the cartridges in order to increase the number of shots available for the same overall size of the ammunition and for the same decoy effect.

A further object of the invention is to simplify the loading and reloading operation so that it takes place without recourse to a tool and in a limited number of manipulations which would considerably reduce the duration of this operation. Reloading at the operations site or in the immediate vicinity would thus be practicable.

According to the present invention this is achieved in that the bolt assembly for securing the magazine to the dispenser in an operative mode comprises one single fixing bolt, which is associated with said magazine in a central location thereof, for interlocking with a corresponding first locking means associated with the dispenser, and a second locking means associated with the magazine and configured to arrest said fixing bolt in its interlocking engagement with said first locking means and prevent it from coming loose due to environmental influence.

Advantageously, said fixing bolt is configured with a threaded screw and the first locking means with a corresponding thread in an electronic housing of the dispenser.

Suitably, said second locking means are configured as a bayonet fitting.

Preferably, said bayonet fitting comprises a locking element connected to the screw and configured with protrusions for hitching in corresponding bayonet recesses arranged in the magazine.

Further features of the dispenser arrangement of the invention will be apparent from the following detailed description with reference to the accompanying drawing.

DESCRIPTION OF EMBODIMENTS OF THE INVENTION

Initial drivers for the present invention are modular design, low weight, low cost and produceability. Therefore, in order to address various competitors dispenser sizes the general design should be highly modular, allowing for a plurality of dispenser sizes to be built from the same basic concept. Further to this purpose, the power unit is designed as a separate module, thus making future growth with alternative power supplies (e.g. 3×115VAC), connector types and positioning possible, without affecting the rest of the dispenser design. Since the power module is intended to be the configurable portion of the dispenser with respect to external electrical interface, connector types etc, it also contains the signal connector and associated filtering.

Figure 1:
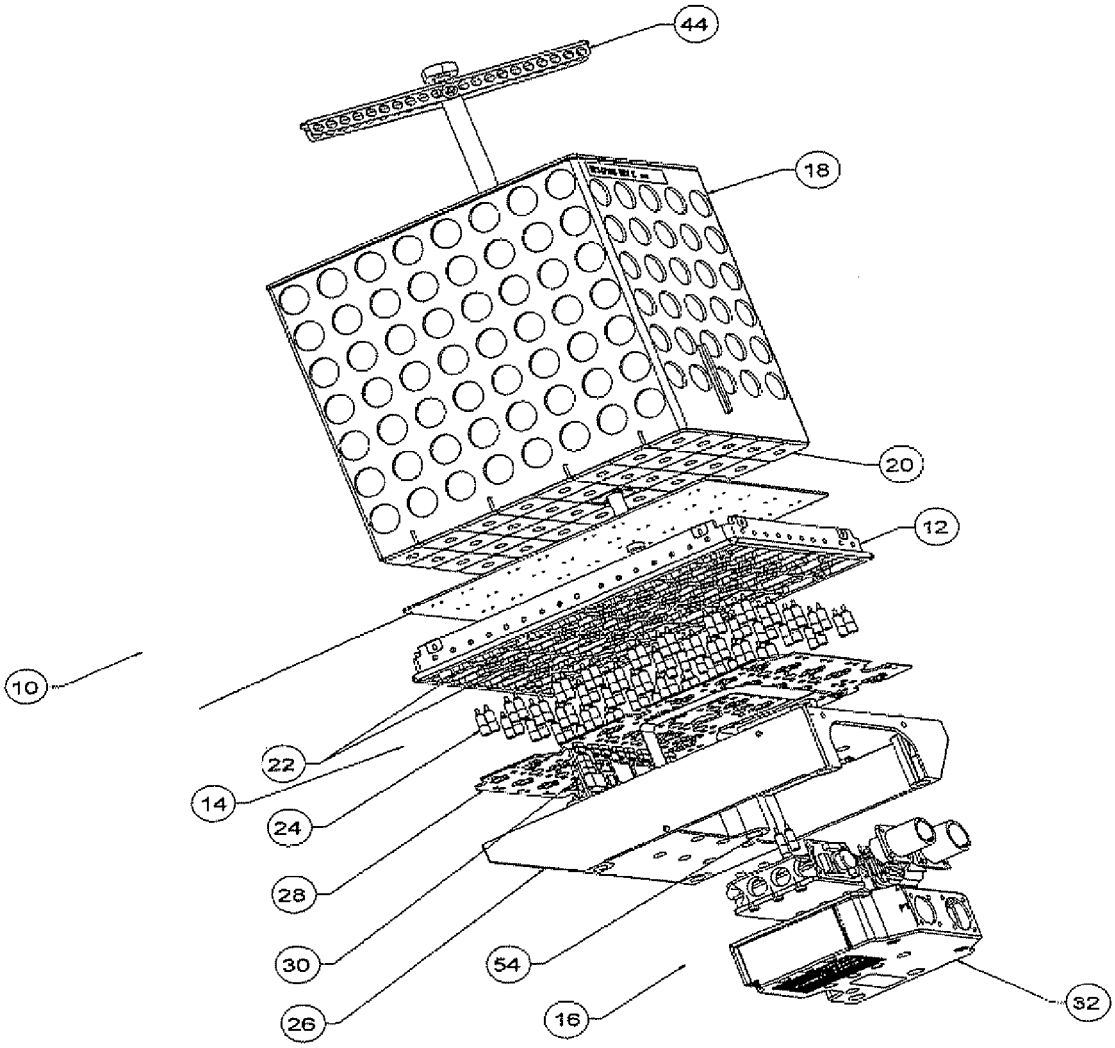
FIG. 1 is a schematic exploded view of a dispenser according to the invention.

FIG. 1 illustrates one embodiment of a modular dispenser 10 for a not shown platform, e.g. a vehicle as an aircraft, a naval vessel, land vehicle or a stationary battle position etc., comprising four major blocks or modules: a breech plate 12 associated with an electronic unit 14, a power unit 16 and a magazine 18 for a plurality of pyrotechnic countermeasure cartridges 20. Said dispenser 10 is configured to be mounted on said platform and connected to its power- and control-systems. Said breech plate 12 is provided with a number of (in the present embodiment 82) apertures 22 for accommodation of the same amount of cartridge connectors 24, intended to connect each cartridge 20 to said electronic unit 14.

The electronic unit 14 might comprise an electronic housing 26, in which a driver board 28 and a controller board 30 are accommodated and held. Each cartridge connector is designed as a conventional double acting pogo-pin 24 configured to connect a cartridge to a corresponding pad of said driver board 28, thus eliminating the need for a solder operation. The connectors, equipped with a standard environmental seal, are simply inserted into said apertures 22 in the breech plate and kept in position by the driver board 28, in cases when the breech plate 12, acting as a lid, is assembled with the electronic housing 26. The electronic unit 14 also interfaces with said power unit 16 which in turn is associated with an external interface of the platform.

The power unit 16 might comprise a power housing 32 accommodating a connector board assembly and a power board assembly containing e.g. power connector, converter, power and safety circuitry, signal connector and associated filters of conventional kinds. Since the power unit 16, when mounted in said power housing 32, would be a separate configurable module with respect to external electrical interface, connector types etc, perhaps a more proper designation would be e-i (electrical interface)-module 16.

The dispenser 10 is mounted to the platform by means of the electronic housing 26, which is bolted to the not shown platform and in turn the power housing 32 is bolted to the electronic housing 26. Advantageously, the power housing is designed as a box without a lid, with two separate filter chambers. As indicated above, it contains not only the power electronics but also the signal filtering and isolation components. It might be designed to allow for an optional orientation of the power and signal connectors, so that these e.g. could face downwards, which would enhance the ease of installation in cases where the dispenser is bolted from the inside of a platform.

Figure 2:
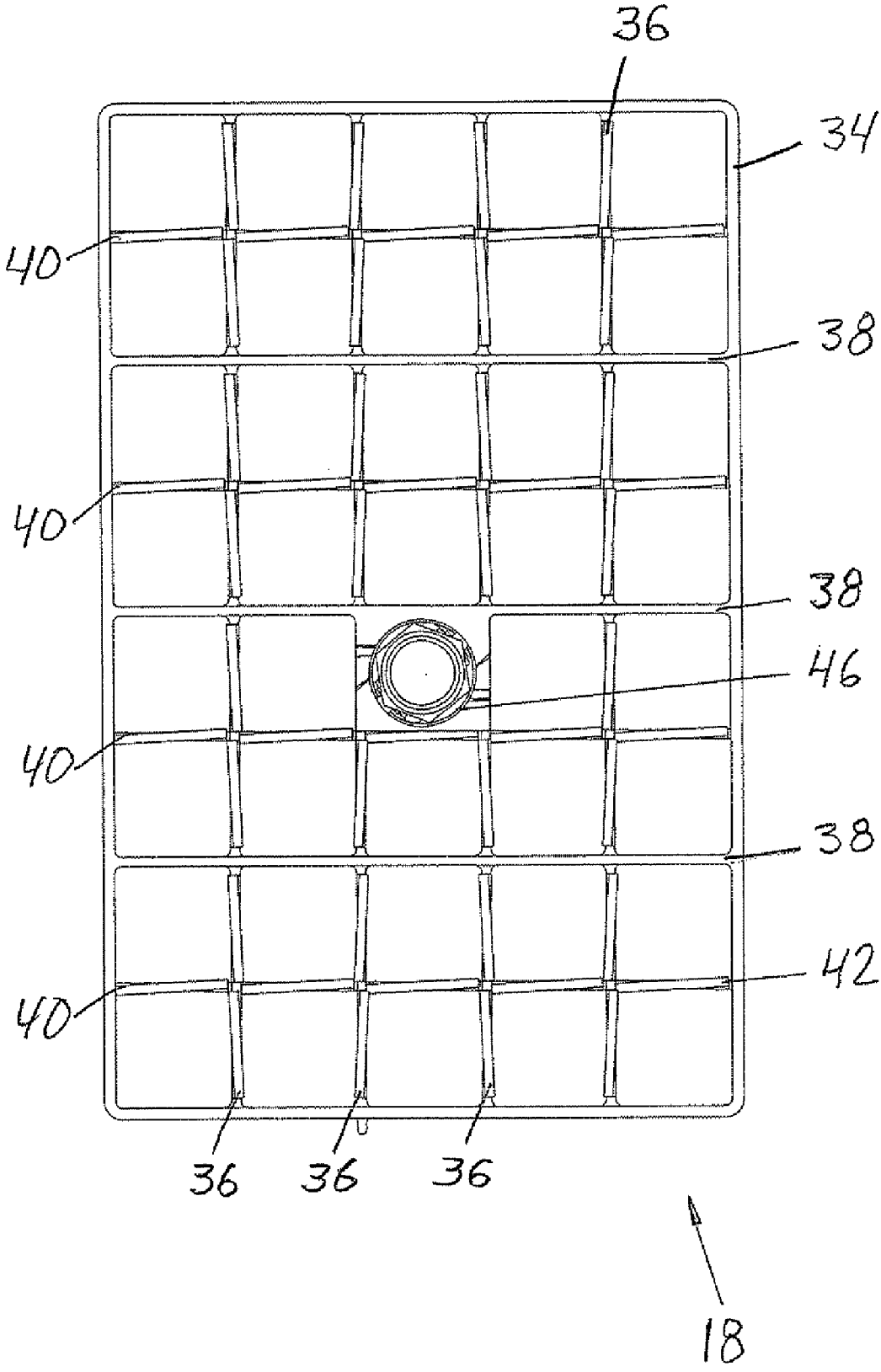
FIG. 2 is a schematic horizontal view of a magazine for the dispenser.

FIG. 2 illustrates the body of said magazine 18 designed as a box, with an open top and bottom, comprising a surrounding wall 34 and is internally divided by means of resilient first separator walls 36 and stiff second separator walls 38 into compartments for a nominal cartridge dimension of 1×2". Said resilient first separator walls 36 are configured with twisted ends 42 towards the top region of the magazine. Further, the magazine might be provided with resilient third separator walls 40 to make the magazine suitable for 1×1" cartridges. Said third separator walls 40 can be inserted from the bottom region of the magazine body and are configured with twisted ends 42 towards its top region. This makes it possible to keep the cartridges in place by means of friction forces induced between appropriate walls 34, 36, 38, 40 and cartridges by means of spring action from said twisted ends 42. In order to reduce weight, all walls of the magazine can be provided with a number of weight saving holes.

The magazine 18 is configured for removable fixation to the electronic housing 26 by means of a bolt assembly 44 associated with the magazine in a central location 46 thereof. This central location of said bolt assembly 44, which consumes one cartridge place near the very centre of the magazine, has been chosen to satisfy requirements of a modular design, allowing for dispensers of different sizes to be built from the same basic concept. Hence, starting from this it is possible to build dispensers and matching magazines appropriate for 4×6, 5×6, 4×8 and 5×8 cartridges minus one. No matter the size of the above listed dispensers, said central location 46 will only be displaced from the very centre of the magazine a small distance between a ½" and $$\frac{\sqrt{2}}{2}",$$

which is satisfactory near the centre of gravity of the magazine—for reasons to be explained later on.

Figure 3:
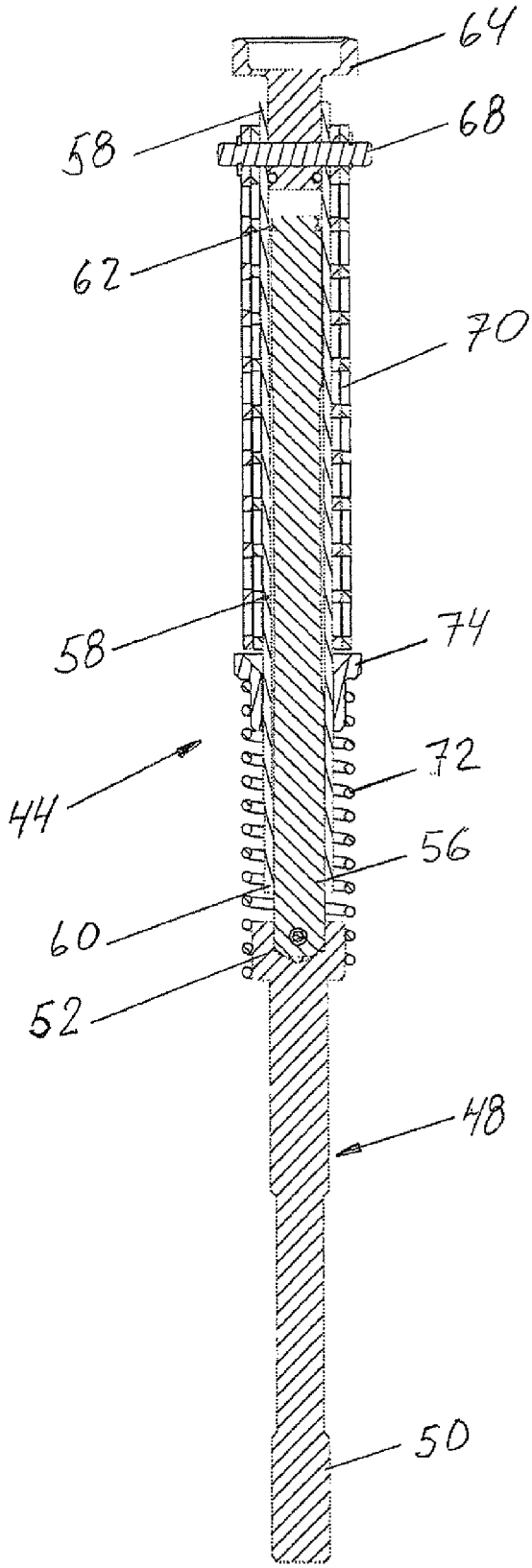
FIG. 3 is a schematic sectional side view of a bolt assembly according to the invention with folded handle in the compressed operative mode.

FIG. 3 illustrates in a sectional side view one embodiment of said bolt assembly 44 in a locking state as configured for securing the magazine 18, the breech plate 12, driver board 28 and controller board 30 to the electronic housing 26 in an operative mode. Advantageously, said bolt assembly is provided with one single fixing bolt, which might be embodied by a conventional socket head cap screw 48, in a first end provided with an external thread 50 and in the second with a socket head cap 52. A first locking means associated with the dispenser 10 can be arranged on the electronic housing 26 and configured as an internal thread 54, in which said external thread 50 of said socket head cap screw 48 is to be tightened in said locking state. For the sake of clarity, the magazine 18 and electronic housing are omitted in FIG. 3 (compare FIG. 1).

Figure 4:
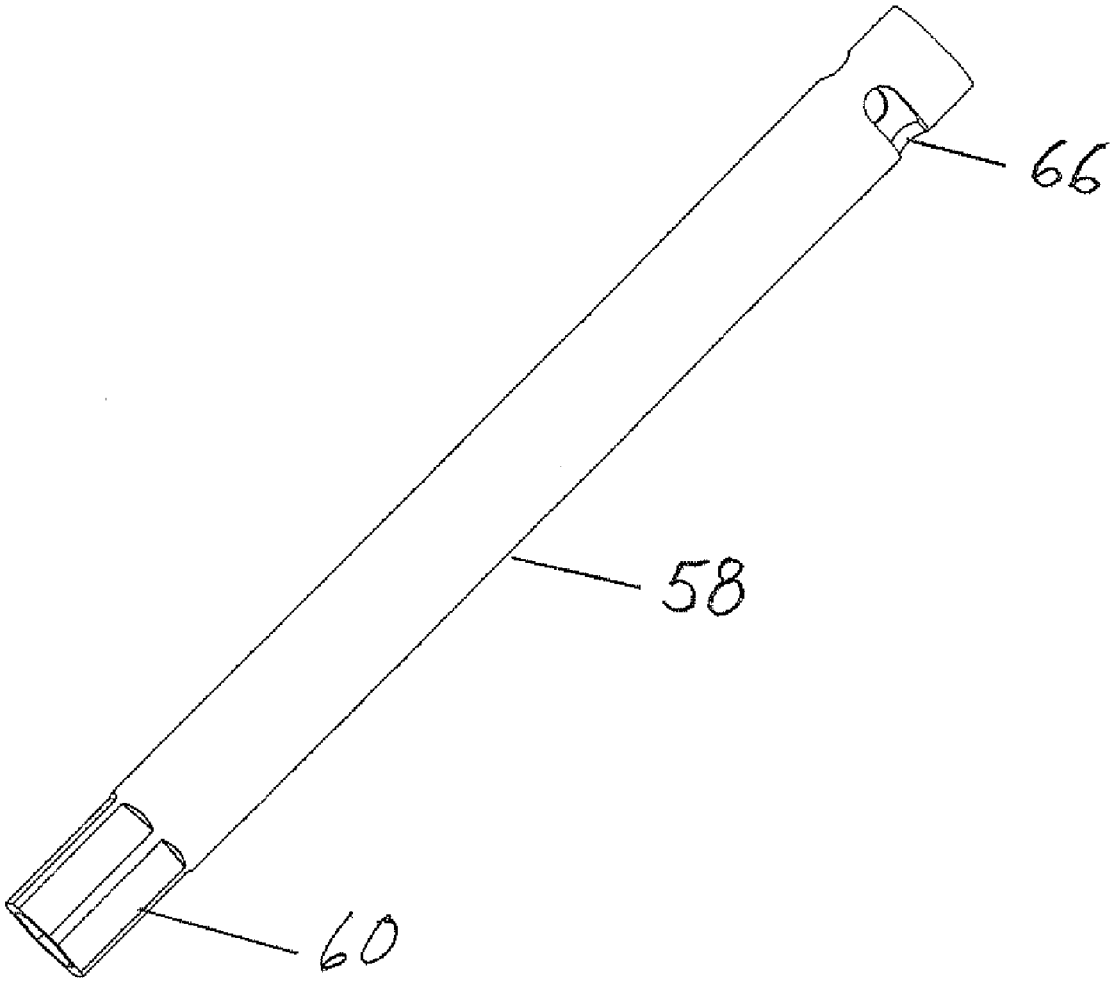
FIG. 4 is a perspective view of a telescope wrench tube of the bolt assembly in FIG. 3.

Further, a hexagon wrench 56, the cross section of which being hexagonal adjacent to the ends and annular in the middle section between the ends, is at a first end secured in engagement with said socket head cap 52, by means of e.g. a conventional cotter pin arrangement. Said hexagon wrench 56 is in displaceable engagement with a telescope wrench tube 58 provided with a hexagon socket 60 flanged in a first end thereof. FIG. 4 is a perspective view which illustrates said telescope wrench tube 58.

The second end of the hexagon wrench 56 is provided with a conventional notch, in which a snap-ring 62 is accommodated. Said snap-ring is configured to bear against the flanging in the transition section to said hexagon socket 60 of said telescope wrench tube 58, when the bolt assembly 44 is fully extended in a non-operative mode. A control knob 64 is associated with the second end of the telescope wrench tube 58 and two opposing circumferential slots 66 are provided adjacent said second end. For reasons which will be explained later, each slot 66 is extended over approximately 90° and configured to accommodate a combined locking element and pivot pin 68 mounted in said control knob 64 and extending through said slots 66. By means of said pivot pin 68 a collapsible handle 70 is suspended in relation to said control knob 64 and telescope wrench tube 58. A compression spring 72, here shown in a compressed state, is a component of the bolt assembly and together with a spring stopper 74 configured to cooperate with the handle 70 as folded and magazine 18, particulars of which will be described later.

Figure 5:
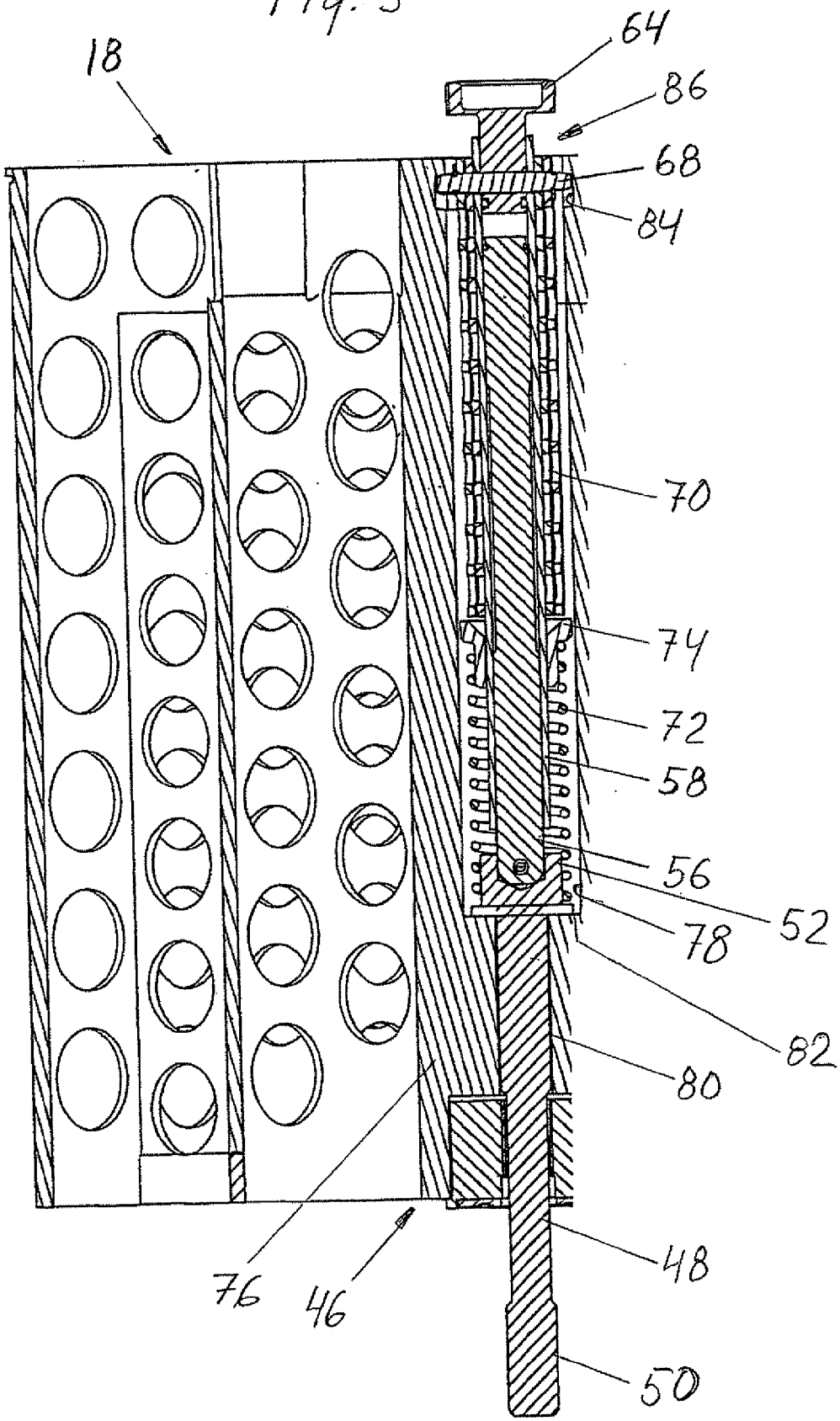
FIG. 5 is a schematic, partially cut out, sectional side view of the bolt assembly in FIG. 3 associated with said magazine.

FIG. 5 illustrates, as described above with reference to FIG. 2, the magazine 18 configured for removable fixation to the electronic housing 26 (FIG. 1) by means of the bolt assembly 44 associated with a cartridge place in a central location 46 of the magazine. In particular, FIG. 5 illustrates an embodiment of said central location 46 of the magazine configured as a body 76 with a cylindrical blind hole 78 for the bolt assembly 44, which here is disclosed in its locking state according to FIG. 3. The socket head cap screw 48, hexagon wrench 56 and telescope wrench tube 58 are interconnected as previously described and extended in said body 76 from bottom to top of the magazine 18.

For this purpose, a bottom hole 80 is bored in the bottom of said blind hole 78 and the socket head cap screw 48 is mounted in said bottom hole 80 to bear with its cap 52, preferably by means of a conventional washer, on a ring shoulder 82 configured in the transition from blind hole to bottom hole. Further, the compression spring 72 is seated on said shoulder 82 and is compressed by the spring stopper 74 under influence of the folded handle 70 such, that the protruding distal ends of the locking element 68 mounted in the control knob 64, by means of spring force are resiliently pressed into and arrested in corresponding bayonet recesses 84, configured in the body 76.

Hence, it is possible to achieve a suitable second locking means 86 comprising the body 76, configured as above described, and the control knob 64 with locking element 68 and folded handle 70 and the compression spring 72. Thereby, said second locking means might be configured as a bayonet fitting 86, comprising the locking element 68 in connection with the fixing bolt 48 and configured with protrusions for hitching in corresponding bayonet recesses 84 arranged in the body 76 of the magazine 18.

As mentioned above two opposing circumferential slots 66 are provided adjacent the second end of telescope wrench tube 58. This is because said bayonet fitting 86, which is configured to be arrested counter clockwise and released clockwise, is configured with a backlash of 30° and the partition of the mesh of the telescope wrench tube 58 with hexagon wrench 56 is 60°. Therefore, each slot 66 is extended over a predetermined angle of approximately 90° and configured to accommodate the locking element 68 mounted in said control knob 64 and extending through said slots 66 to be movable in the slots, that is approximately over 90°. This will enable the telescope wrench tube 58, which when mounting the magazine to the dispenser, after the screw 48 is tightened in the thread of the electronic housing, is displaced from its extended handling state and in an intermediate position is free to rotate in relation to the hexagon wrench 56, to engage with and finally lock the screw when bayonet fitting 86 is arrested. Thereby, the socket head cap screw 48 is prevented from rotating in any case no more than a maximum of 60°, which it can never come loose and its external thread 50 is securely maintained in engagement with the internal thread 54 of the electronic housing 26. Thereby, the complete dispenser 10 comprising breech plate 12, electronic unit 14, power unit 16 and magazine 18 is reliably secured to the platform.

Figure 6:
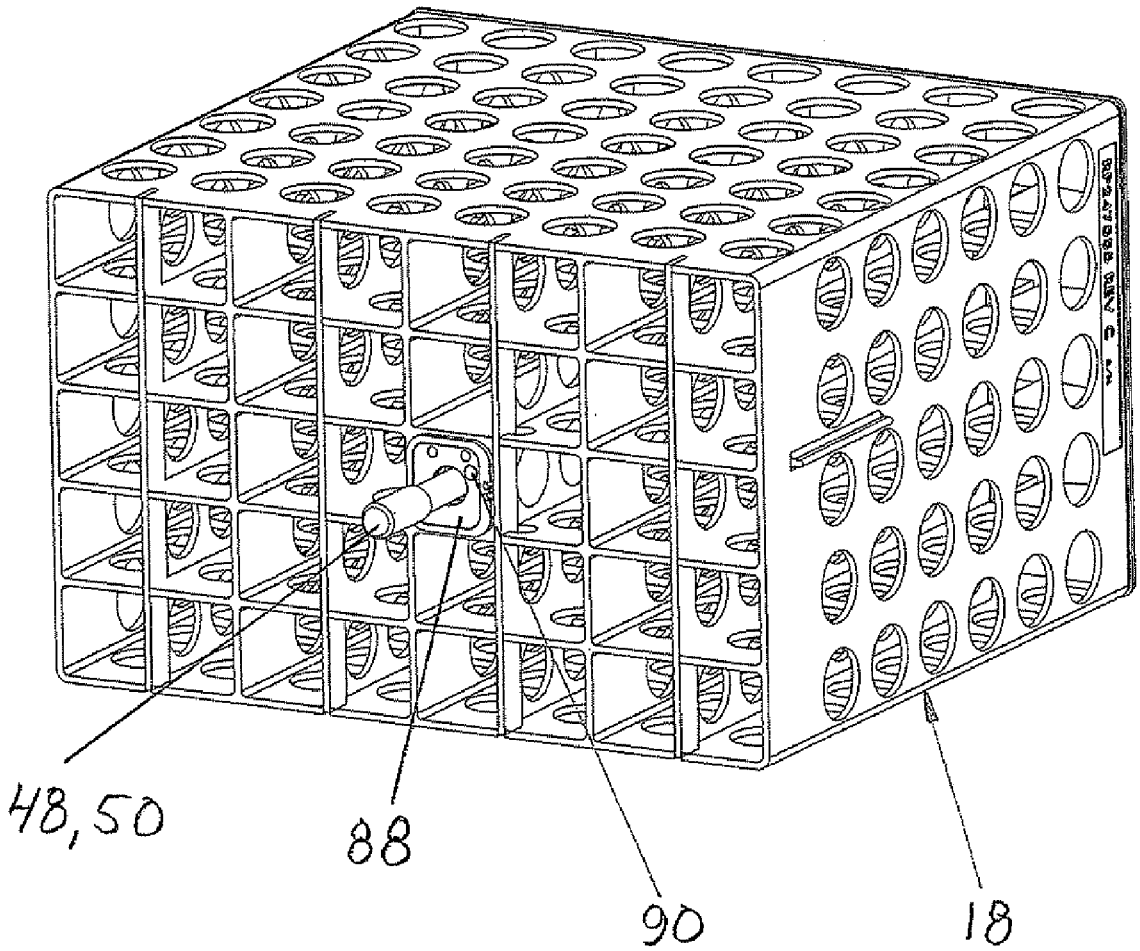
FIG. 6 is a perspective bottom view of the magazine in FIG. 2, which illustrates an ID-unit associated with the magazine in relation to the bolt assembly.

FIG. 6 is a perspective bottom view of the magazine in FIG. 2, which illustrates an ID-unit 88 associated with the magazine 18 in relation to the bolt assembly in the central location 46 at the bottom of the magazine. In particular, it discloses the end of socket head cap screw 48 with its external thread 50, protruding through an appropriate opening in said ID-unit 88. The ID-unit can be electrically connected by pads 90 meeting the connectors 24 from the breech plate 12. The opening in the unit is equipped with a self-braking internal thread corresponding to the external thread 50 of the fixing bolt. The unit is provided with a unique magazine code containing data as to the present armament of the magazine and therefore the unit is to be changed when changing the magazine code.

Figure 7:
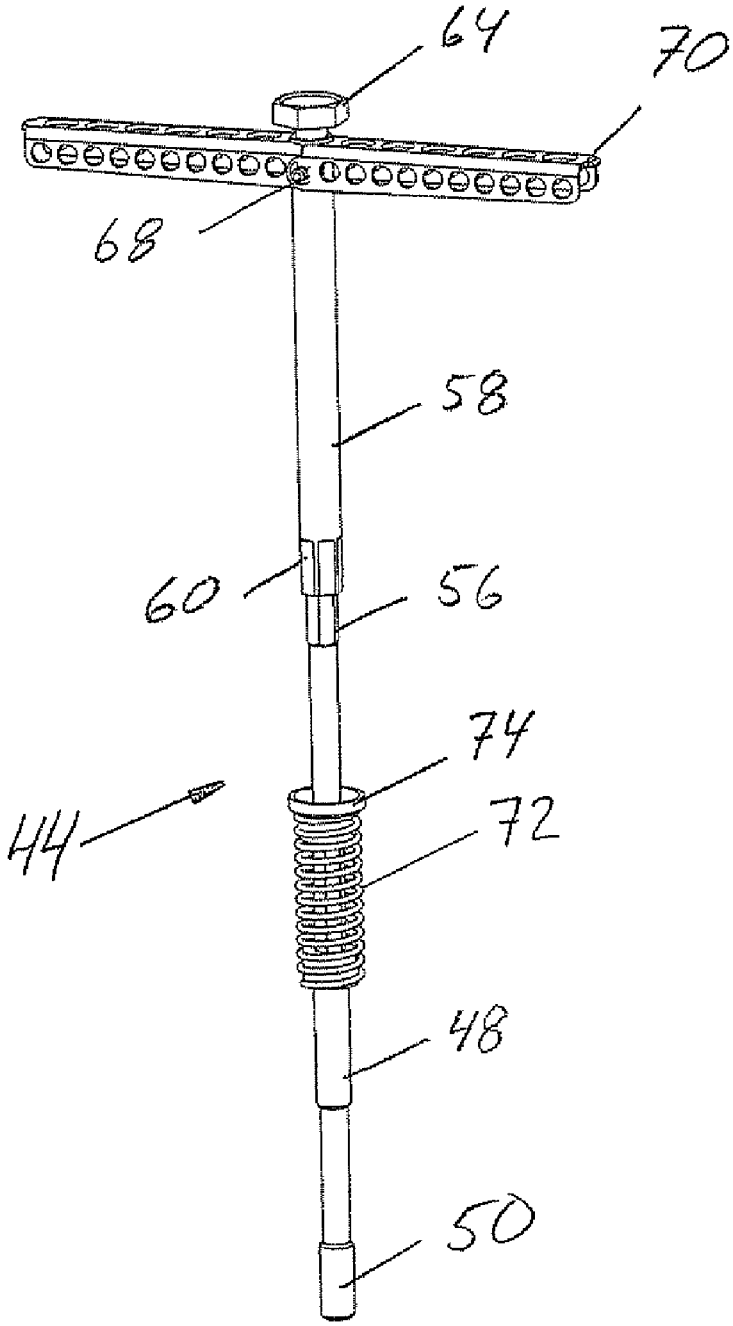
FIG. 7 is a perspective view of the bolt assembly in FIG. 3, but in a fully extended non-operative mode with unfolded handle.
Figure 8:
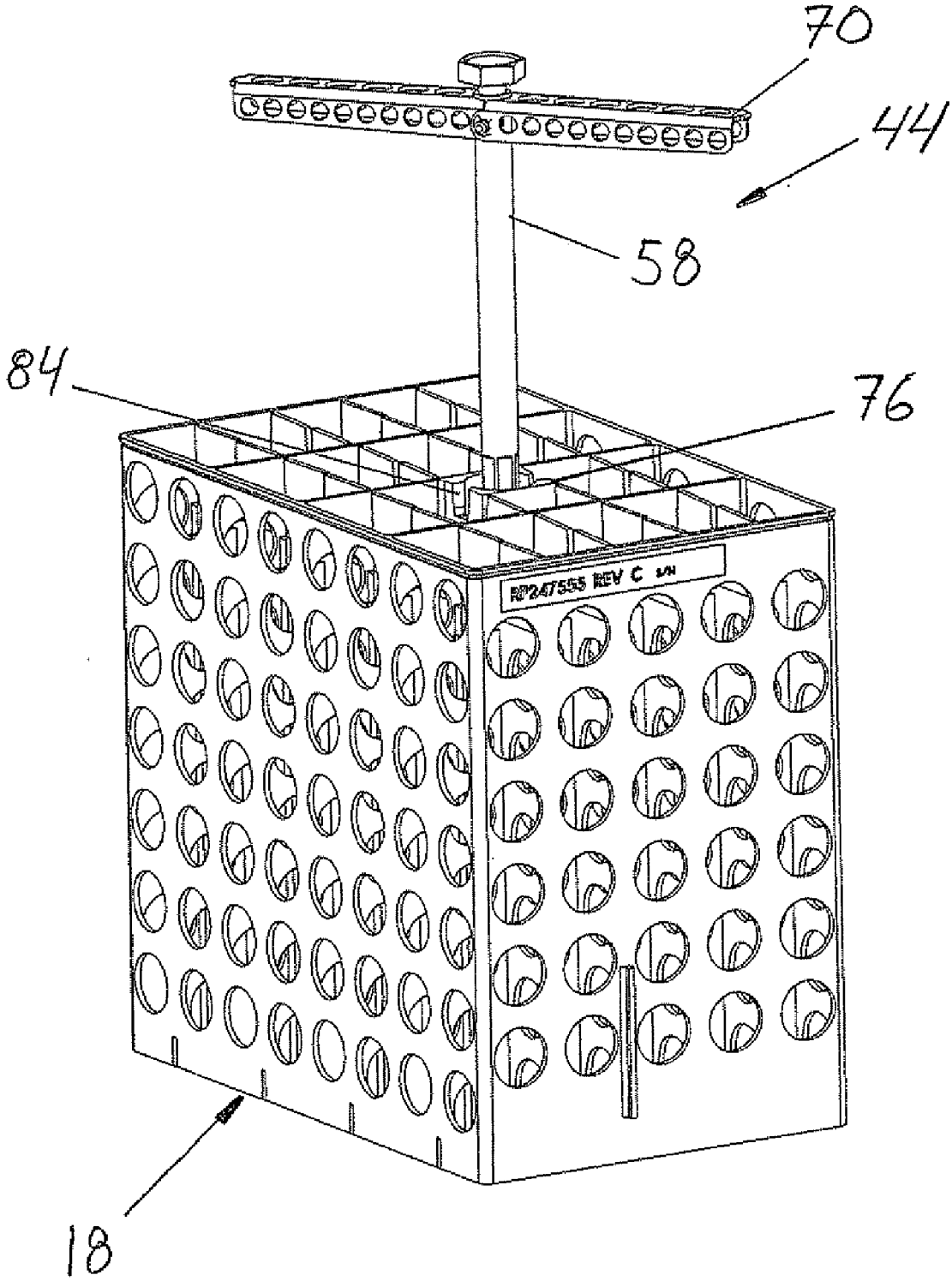
FIG. 8 is a perspective view of the bolt assembly in FIG. 6 associated with the magazine.

FIGS. 7 and 8 are perspective views which illustrate the bolt assembly 44 of FIG. 3, but in a handling state in its fully extended, non-operative mode. In this mode the handle 70 is unfolded, the hexagon wrench 56 and telescope tube 58 are fully extended, whereby the snap-ring 62 is in contact with the flanging in the transition section to said hexagon socket 60 of said telescope tube 58. This means the compression spring 72 and spring stopper 74 are relieved and the fixing bolt 48 is ready to be untightened from internal thread 54 in the electronic housing 26 by means of the handle 70. AS the ID-unit 88 is provided with a self-braking internal thread corresponding to the external thread 50 of the fixing bolt, it is possible to pull out or lift up and reliably carry away the magazine 18 by means of the handle 70, with no risk of the magazine would rotate and come loose.

Figure 9:
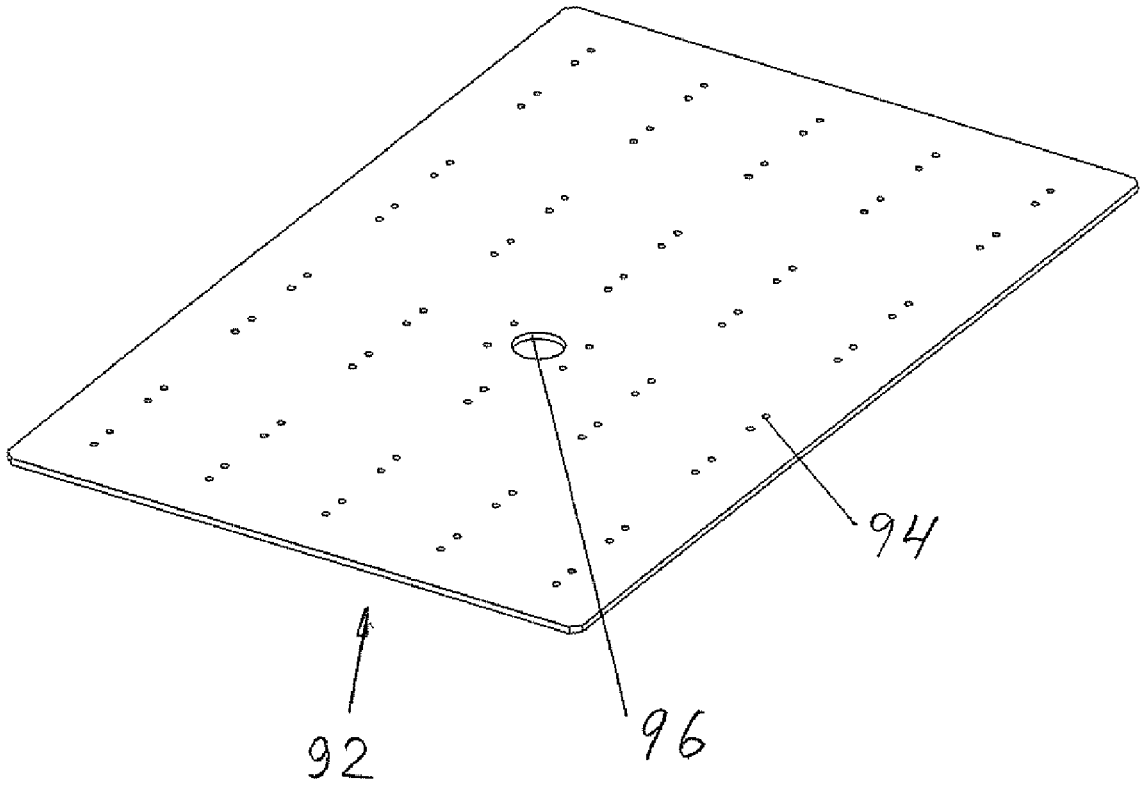
FIG. 9 is a perspective view which illustrates a flexible sheet configured to be positioned between the dispenser and the magazine.

FIG. 9 is a perspective view which illustrates a flexible sheet 92 configured to be positioned between dispenser 10 and the magazine 18. It is configured to take up dimensional tolerances in cartridge flange thickness, thereby holding each cartridge 20 firmly in place. It will further act as a damper, lowering the impulses transmitted to the breech plate when dispensing. The flexible sheet will also act as a first environmental seal for the cartridge connectors 24. Finally the sheet prevents eventual chaff from entering the connectors or cartridge squibs. The sheet is provided with appropriate openings 94 and 96 for the connectors 24 and the fixing bolt 48 respectively. The sheet might be produced of rubber or plastic material, advantageously of silicone.

Even if the exemplified embodiments of the invention are directed to components of specific design, it is possible to alternate for example the first and second locking means as known form prior art, without extending beyond the scope of protection as appear from the appended claims.

To protect the magazine, payload and breech plate from sand, liquids etc. for example during handling and transports, a magazine lid might be used. It would be of the "remove before flight" type, preferably removed when the magazine is mounted to the platform. Said lid might be configured with a central "dome", which is to be placed over the control knob and provided with a displaceable pullock for engagement behind the control knob and thereby secure the magazine lid to the magazine.

The invention claimed is:

1. A dispenser arrangement for a platform, configured to be mounted to the platform and connected to power- and control-systems of the platform, the dispenser arrangement comprising:

a dispenser;

a magazine for a plurality of pyrotechnic countermeasure cartridges, the magazine being configured for removable fixation to the dispenser; and a bolt assembly configured to secure the magazine to the dispenser in an operative mode, the bolt assembly comprising one single fixing bolt, which is associated with the magazine in a central location thereof, for interlocking with a corresponding first lock associated with the dispenser, and a second lock associated with the magazine and configured to arrest said fixing bolt in interlocking engagement with said first lock and preventing the fixing bolt from coming loose due to environmental influence.

2. The dispenser arrangement according to claim 1, wherein said fixing bolt comprises a thread and the first lock comprises a corresponding thread in an electronic housing of the dispenser.

3. The dispenser arrangement according to claim 1, wherein the second lock comprises a bayonet fitting.

4. The dispenser arrangement according to claim 3, wherein the bayonet fitting comprises a locking element connected to the fixing bolt and comprising protrusions for hitching in corresponding bayonet recesses arranged in the magazine.

5. The dispenser arrangement according to claim 4, further comprising:

a telescope wrench tube arranged between the fixing bolt and bayonet fitting, the telescope tube comprising slots adjacent a first end, the slots permitting the bayonet fitting to rotate a determined angle in relation to the telescope tube.

6. The dispenser arrangement according to claim 1, wherein the bolt assembly is telescopic and comprises a control knob comprising a collapsible handle, and wherein the control knob is adjustable from an operative mode, in which the magazine is interlocked with an electronic housing and a non-operative mode in which the magazine is removable from the electronic housing.

7. The dispenser arrangement according to claim 1, wherein the magazine is divided into cartridge compartments, each cartridge compartment comprising at least one resilient first separator wall for keeping each cartridge in place by friction.

8. The dispenser arrangement according to claim 7, wherein each cartridge compartment further comprises resilient second separator walls for keeping each cartridge of a different size in place by friction.

9. The dispenser arrangement according to claim 8, wherein said first and second separator walls are each inserted from a bottom region of the magazine and comprise twisted ends towards a top region of the magazine.

10. The dispenser arrangement according to claim 1, wherein the magazine comprises an ID-unit comprising a unique magazine code in a central location at a bottom of the magazine for transferring the magazine code to the platform via pads meeting corresponding connectors from a breech plate.

11. The dispenser arrangement according to claim 10, wherein the ID-unit comprises an opening comprising a self-braking internal thread corresponding to an external thread of the fixing bolt.

12. The dispenser arrangement according to claim 1, further comprising:

a flexible sheet positioned between the dispenser and the magazine.

13. The dispenser arrangement according to claim 12, further comprising:

a breech plate, wherein said flexible sheet is positioned between the breech plate and the magazine.

14. The dispenser arrangement according to claim 1, wherein the magazine is divided into cartridge compartments and each compartment comprises at least one resilient first separator wall for keeping each cartridge in place by friction.

15. The dispenser arrangement according to claim 14, wherein each cartridge compartment is further divided by resilient second separator walls for keeping each cartridge of a different size in place by friction.

16. The dispenser arrangement according to claim 15, wherein the first and the second separator walls are each inserted from a bottom region of the magazine and configured with twisted ends towards a top region of the magazine.

* * * * *